US009359560B2

(12) United States Patent
Wang et al.

(10) Patent No.: US 9,359,560 B2
(45) Date of Patent: Jun. 7, 2016

(54) HEAT TRANSFER TUBE AND CRACKING FURNACE USING THE HEAT TRANSFER TUBE

(71) Applicants: CHINA PETROLEUM & CHEMICAL CORPORATION, Beijing (CN); BEIJING RESEARCH INSTITUTE OF CHEMICAL INDUSTRY, CHINA PETROLEUM & CHEMICAL CORP., Beijing (CN)

(72) Inventors: Guoqing Wang, Beijing (CN); Lijun Zhang, Beijing (CN); Xianfeng Zhou, Beijing (CN); Junjie Liu, Beijing (CN); Zhiguo Du, Beijing (CN); Yonggang Zhang, Beijing (CN); Zhaobin Zhang, Beijing (CN); Cong Zhou, Beijing (CN)

(73) Assignees: CHINA PETROLEUM & CHEMICAL CORPORATION, Beijing (CN); BEIJING RESEARCH INSTITUTE OF CHEMICAL INDUSTRY, CHINA PETROLEUM & CHEMICAL CORPORATION, Beijing (CN)

( * ) Notice: Subject to any disclaimer, the term of this patent is extended or adjusted under 35 U.S.C. 154(b) by 0 days.

(21) Appl. No.: 14/065,731

(22) Filed: Oct. 29, 2013

(65) Prior Publication Data

US 2014/0127091 A1 May 8, 2014

(30) Foreign Application Priority Data

Oct. 30, 2012 (CN) ..... 2012 1 0426112

(51) Int. Cl.
*C10G 9/20* (2006.01)
*F28F 13/02* (2006.01)
(Continued)

(52) U.S. Cl.
CPC .. *C10G 9/20* (2013.01); *F15D 1/06* (2013.01); *F28F 1/40* (2013.01); *F28F 13/02* (2013.01);
(Continued)

(58) Field of Classification Search
USPC ..... 422/205, 645, 659, 651; 165/184
See application file for complete search history.

(56) References Cited

U.S. PATENT DOCUMENTS 1,056,373 A * 3/1913 Segelken ..... 138/38
4,455,154 A * 6/1984 Blasiole ..... 48/77
(Continued)

FOREIGN PATENT DOCUMENTS

CN 2 101 210 U 4/1992
CN 2101210 4/1992
(Continued)

OTHER PUBLICATIONS

Search Report in United Kingdom Application No. GB1319549.0, date of search May 18, 2014.
(Continued)

*Primary Examiner* — Lessanework Seifu
(74) *Attorney, Agent, or Firm* — Finnegan, Henderson, Farabow, Garrett & Dunner LLP

(57) ABSTRACT

The present disclosure relates to a heat transfer tube and a cracking furnace using the heat transfer tube. The heat transfer tube comprises a twisted baffle arranged in an inner wall of the tube, said twisted baffle extending spirally along an axial direction of the heat transfer tube. The twisted baffle defines a closed circle viewed from an end of the heat transfer tube. Along the trajectory of the circle a casing is arranged, which is fixedly connected to a radial inner end of the twisted baffle. The twisted baffle is provided with a plurality of holes. The heat transfer tube according to the present disclosure has a good heat transfer effect and small pressure loss.

12 Claims, 4 Drawing Sheets

(51) Int. Cl.

| | |
|---|---|
| ***F28F 1/40*** | (2006.01) |
| ***F15D 1/06*** | (2006.01) |
| *F15D 1/00* | (2006.01) |
| *F28D 21/00* | (2006.01) |

(52) U.S. Cl.
CPC ..... *F15D 1/0025* (2013.01); *F28D 2021/0059* (2013.01); *F28F 2215/08* (2013.01); *Y10T 137/2087* (2015.04)

(56) References Cited

U.S. PATENT DOCUMENTS

| | | | | |
|---|---|---|---|---|
| 5,605,400 | A * | 2/1997 | Kojima | 366/339 |
| 2002/0007941 | A1 | 1/2002 | Zhu et al. | |
| 2010/0147672 | A1* | 6/2010 | Wang et al. | 202/222 |
| 2011/0094720 | A1 | 4/2011 | Wang et al. | |
| 2012/0203049 | A1 | 8/2012 | McCarthy et al. | |

FOREIGN PATENT DOCUMENTS

| | | |
|---|---|---|
| CN | 100365368 | 1/2006 |
| CN | 103061887 | 4/2013 |
| DE | 2430584 | 1/1976 |
| EP | 2 133 644 A1 | 12/2009 |
| JP | 8-68526 | 3/1986 |
| JP | 62-268994 | 11/1987 |
| JP | 1-318865 | 12/1989 |
| JP | 6-34231 | 2/1994 |
| JP | 2009-186063 | 8/2009 |

OTHER PUBLICATIONS

Search Report in Singapore Application No. 2013080528, dated Sep. 26, 2014.

Search Report and Written Opinion from Belgian Patent Office, Application No. 201300735, issued May 20, 2015.

* cited by examiner

HEAT TRANSFER TUBE AND CRACKING FURNACE USING THE HEAT TRANSFER TUBE

This application claims benefit of priority under 35 U.S.C. §119 to Chinese Patent Application No. CN 201210426112.4, filed Oct. 30, 2012, the contents of which are also incorporated herein by references.

TECHNICAL FIELD

The present disclosure relates to a heat transfer tube which is especially suitable for a heating furnace. The present disclosure further relates to a cracking furnace using the heat transfer tube.

TECHNICAL BACKGROUND

Cracking furnaces, the primary equipment in the petrochemical industry, are mainly used for heating hydrocarbon material so as to achieve cracking reaction which requires a large amount of heat. Fourier's theorem says, $$\frac{q}{A} = -k\frac{dt}{dy}$$

wherein q is the heat transferred, A represents the heat transfer area, k stands for the heat transfer coefficient, and dt/dy is the temperature gradient. Taking a cracking furnace used in the petrochemical industry as an example, when the heat transfer area A (which is determined by the capacity of the cracking furnace) and the temperature gradient dt/dy are determined, the only way to improve the heat transferred per unit area q/A is to improve the value of the heat transfer coefficient k, which is subject to influences from thermal resistance of the main fluid, thermal resistance of the boundary layer, etc.

In accordance with Prandtl's boundary layer theory, when an actual fluid flows along a solid wall, an extremely thin layer of fluid close to the wall surface would be attached to the wall without slippage. That is to say, the speed of the fluid attached to the wall surface, which forms a boundary layer, is zero. Although this boundary layer is very thin, the heat resistance thereof is unusually large. When heat passes through the boundary layer, it can be rapidly transferred to the main fluid. Therefore, if the boundary layer can be somehow thinned, the heat transferred would be effectively increased.

In the prior art, the furnace pipe of a commonly used cracking furnace in the petrochemical industry is usually structured as follows. On the one hand, a rib is provided on the inner surface of one or more or all of the regions from the inlet end to the outlet end along the axial direction of the furnace coil in the cracking furnace, and extends spirally on the inner surface of the furnace coil along an axial direction thereof. Although the rib can achieve the purpose of agitating the fluid so as to minimize the thickness of the boundary layer, the coke formed on the inner surface thereof would continuously weaken the role of the rib as time lapses, so that the function of reducing the boundary layer thereof will become smaller. On the other hand, a plurality of fins spaced from one another are provided on the inner surface of the furnace pipe. These fins can also reduce the thickness of the boundary layer. However, as the coke on the inner surface of the furnace pipe is increased, these fins will similarly get less effective.

Therefore, it is important in this technical field to enhance heat transfer elements so as to further improve heat transfer effect of the furnace coil.

SUMMARY OF THE INVENTION

To solve the above technical problem in the prior at, the present disclosure provides a heat transfer tube, which possesses good transfer effects. The present disclosure further relates to a cracking furnace using the heat transfer tube.

According to a first aspect of the present disclosure, it discloses a heat transfer tube comprising a twisted baffle arranged on an inner wall of the tube, said twisted baffle extending spirally along an axial direction of the heat transfer tube.

In the heat transfer tube according to the present disclosure, under the action of the twisted baffle, fluid flows along the twisted baffle and turns into a rotating flow. A tangential speed of the fluid destroys the boundary layer so as to achieve the purpose of enhancing heat transfer.

In one embodiment, the twisted baffle is provided with a plurality of holes. Both axial and radial flowing fluids can flow through the holes, i.e., these holes can alter the flow directions of the fluids, so as to enhance turbulence in the heat transfer tube, thus destroying the boundary layer and achieving the purpose of enhancing heat transfer. In addition, fluids from different directions can all conveniently pass through these holes and flow downstream, thereby further reducing resistance to flow of the fluids and reducing pressure loss. Coke pieces carried in the fluids can also pass through these holes to move downstream, which facilitates the discharge of the coke pieces.

In a preferred embodiment, the ratio of the sum area of the plurality of holes to the area of the twisted baffle is in a range from 0.05:1 to 0.95:1. When the ratio is of a small value in the above range, the heat transfer tube is of high capacity, but the pressure drop of the fluid is great. As the value of the ratio turns greater, the heat transfer tube would be of lower capacity, but the pressure drop of the fluid grows smaller accordingly. When the ratio ranges from 0.6:1 to 0.8:1, the capacity of the heat transfer tube and the pressure drop of the fluid both fall within a proper scope. The ratio of an axial distance between the centerlines of two adjacent holes to an axial length of the twisted baffle ranges from 0.2:1 to 0.8:1.

In one embodiment, the twisted baffle has a twist angle of between 90° to 1080°. When the twist angle is relatively small, the pressure of the fluid and the tangential speed of the rotating fluid are both small. Therefore, the heat transfer tube is of poor effect. As the twist angle turns larger, the tangential speed of the rotating flow would increase, so that the effect of the heat transfer tube would be improved, but the pressure drop of the fluid will be increased. When the twist angle ranges from 120°-360°, the capacity of the heat transfer tube and the pressure drop of the fluid both fall within a proper range. One single region of the heat transfer tube can be provided with a plurality of twisted baffles parallel to one another, which define an enclosed circle viewed from one end of the heat transfer tube. In a preferred embodiment, the diameter ratio of the circle to the heat transfer tube falls within a range from 0.05:1 to 0.95:1. When this ratio is relatively small, the heat transfer tube is of high capacity but the pressure drop of the fluid is great. As the value of the ratio gradually increases, the capacity of the heat transfer tube would be decreased, but the pressure drop of the fluid would accordingly turn small. When this ratio ranges from 0.6:1 to 0.8:1, both the capacity of the heat transfer tube and the pressure drop of the fluid would fall within respective proper scopes. This arrangement renders that only the portion closed to the heat transfer tube wall is provided with a twisted baffle while the central portion of the heat transfer tube actually forms a channel. In this way, when the fluid flows through the heat transfer tube, part of the fluid can directly flows out of the tube through the channel, so that not only a better heat transfer effect can be achieved but the pressure loss is also small. Moreover, the channel also enables the coke pieces to be quickly discharged therefrom.

In a preferred embodiment, the ratio of the axial length of the twisted baffle to an inner diameter of the heat transfer tube is a range from 1:1 to 10:1. When this ratio is relatively small, the tangential speed of the rotating flow is relatively great, so that the heat transfer tube is of high capacity but the pressure drop of the fluid is relatively great. As the value of the ratio gradually increases, the tangential speed of the rotating flow would turn smaller, and thus the capacity of the heat transfer tube would be decreased, but the pressure drop of the fluid would turn smaller. When this ratio ranges from 2:1 to 4:1, both the capacity of the heat transfer tube and the pressure drop of the fluid would fall within respective proper scopes. The twisted baffle of such size further enables the fluid in the heat transfer tube with a tangential speed sufficient enough to destroy the boundary layer, so that a better heat transfer effect can be achieved and there would be a smaller tendency for coke to be formed on the heat transfer wall.

In one embodiment, along the trajectory of the circle a casing is arranged and fixedly connected to a radial inner end of the twisted baffle. With the arrangement of the casing, the rotating flow of the fluid would not be affected by the flow inside the casing, which further improves the tangential speed of the fluid, enhances the heat transfer and reduces coke on the heat transfer all. Furthermore, the casing also improves the strength of the twisted baffle. For example, the casing can effectively support the twisted baffle, thus enhancing the stability and impact resistance thereof.

According to a second aspect of the present disclosure, it discloses a cracking furnace, a radiant coil of which comprises at least one, preferably 2 to 10 heat transfer tubes according to the first aspect of the present disclosure.

In one embodiment, the plurality of heat transfer tubes are arranged in the radiant coil along an axial direction thereof in a manner of being spaced from each other. The ratio of the spacing distance to the diameter of the heat transfer tube is in a range from 15:1 to 75:1, preferably from 25:1 to 50:1. The plurality of heat transfer tubes spaced from each other can continuously change the fluid in the radiant coil from piston flow into rotating flow, thus improving the heat transfer efficiency.

In the context of the present disclosure, the term "piston flow" ideally means that fluids mix with each other in the flow direction but by no means in the radial direction. Practically however, only approximate piston flow rather than absolute piston flow can be achieved.

Compared with the prior art, the present disclosure excels in the following aspects. To begin with, the arrangement of the twisted baffle in the heat transfer tube turns the fluid flowing along the twisted baffle into a rotating fluid, thus improving the tangential speed of the fluid, destroying the boundary layer and achieving the purpose of enhancing heat transfer. Next, the plurality of holes provided on the twisted baffle can change the flow direction of the fluid so as to strengthen the turbulence in the heat transfer tube and achieve the object of enhancing heat transfer. Besides, these holes further reduce the resistance in the flow of the fluid, so that pressure loss is further decreased. Moreover, coke pieces carried in the fluid can also move downstream through these holes, which promotes the discharge of the coke pieces. When one single region of the heat transfer tube is provided with a plurality of twisted baffles parallel to one another, which define an enclosed circle viewed from one end of the heat transfer tube, a central portion of the heat transfer tube actually forms a channel, which can lower pressure loss and is favorable for rapid discharge of the coke pieces. Furthermore, along the trajectory of the circle a casing is arranged. Therefore, the casing, twisted baffle and inner wall of the heat transfer tube form a spiral cavity together, wherein the fluid is turned into a complete rotating flow, which further improves the tangential speed of the fluid, thus further enhancing the heat transfer and reducing formation of coke on the wall of the heat transfer tube. In addition, the casing can support the twisted baffle, thereby improving the stability and impact resistance of the twisted baffle.

BRIEF DESCRIPTION OF DRAWINGS

In the following, the present disclosure will be described in detail in view of specific embodiments and with reference to the drawings, wherein, FIG. 1 schematically shows a perspective view of a first embodiment of the heat transfer tube according to the present disclosure.

Figure 1:
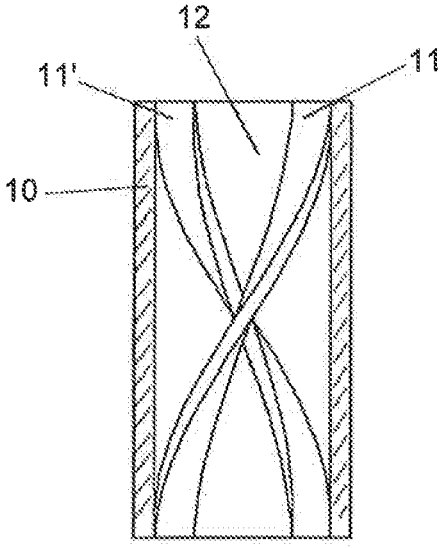

In the drawings, the same component is referred to with the same reference sign. The drawings are not drawn in accordance with an actual scale.

DETAILED DESCRIPTION OF EMBODIMENTS

The present disclosure will be further illustrated in the following in view of the drawings.

Figure 4:
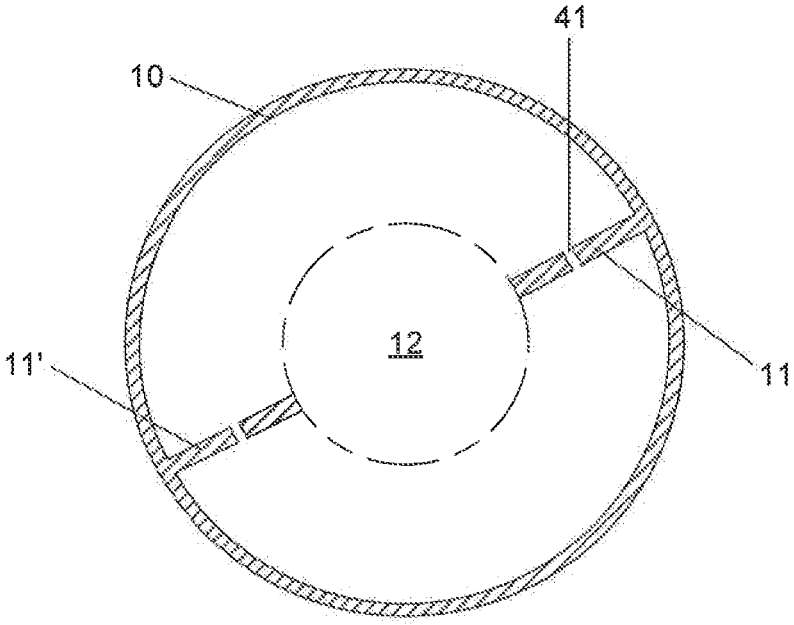
FIG. 4 schematically shows a cross-section view of the second embodiment of the heat transfer tube according to the present disclosure.

FIG. 1 schematically shows a perspective view of a first embodiment of a heat transfer tube 10 according to the present disclosure. The heat transfer tube 10 is provided with two twisted baffles 11 and 11' for introducing a fluid to flow rotatably. The twisted baffles 11 and 11' are parallel to each other and extend spirally along an axial direction of the heat transfer tube 10, the structure of which is similar with the double helix structure of DNA molecules. The twisted baffles 11 and 11' have a twist angle between 90 and 1080° so that they define a through vertical passage 12 (i.e., a circle 12 as shown in FIG. 4) along the axial direction of the heat transfer tube 10. However, the twisted baffles can also be a sheet body instead of defining the vertical passage 12, which will be described in the following.

The twisted baffles not defining the vertical passage can be understood as a trajectory surface which is achieved through rotating one diameter line of the heat transfer tube 10 around a midpoint thereof and at the same time translating it along the axial direction of the heat transfer tube 10 upwardly or downwardly. In contrast, the twisted baffles defining the vertical passage can be formed through removing from a cylinder coaxial with the heat transfer tube 10 a central portion of the twisted baffles not defining the vertical passage, by means of which two identical parallel twisted baffles as shown in FIG. 1 can be formed. In this way, the two twisted baffles 11 and 11' both comprise a top edge and a bottom edge parallel to each other as well as a pair of twisted side edges which always contact with an inner wall of the heat transfer tube 10.

An embodiment of the twisted baffle as indicated in FIG. 1 will be described with the twisted baffle 11 as an example in the following. The ratio of the axial length of the twisted baffle 11 to an inner diameter of the heat transfer tube 10 is in a range from 1:1 to 10:1. The axial length of the twisted baffle 11 can be called as a "pitch", and the ratio of the "pitch" to the inner diameter of the heat transfer tube 10 can be called a "twist ratio". The twist angle and twist ratio would both influence the rotation degree of the fluid in the heat transfer tube 10. When the twist ratio is determined, the larger the twist angle is, the higher the tangential speed of the fluid will be, but the pressure drop of the fluid would also be correspondingly higher. The twisted baffle 11 is selected as with a twist ratio and twist angle which can enable the fluid in the heat transfer tube 10 to possess a sufficiently high tangential speed to destroy the boundary layer, so that a good heat transfer effect can be achieved. In this case, a smaller tendency for coke to be formed on the inner wall of the heat transfer tube can be resulted and the pressure drop of the fluid can be controlled as within an acceptable scope.

Since the twisted baffles 11 and 11' extend spirally, the fluid would turn from a piston flow into a rotating flow under the guidance of the twisted baffles 11 and 11'. With a tangential speed, the fluid would destroy the boundary layer so as to enhance heat transfer. Moreover, there would be a smaller tendency for coke to be formed on the inner wall of the heat transfer tube 10 in view of the tangential speed of the fluid. Further, besides improving the heat transfer effect, the channel defined by the twisted baffles 11 and 11' (i.e., the vertical passage as mentioned above or the circle 12 as indicated in FIG. 4) can also reduce the resistance to the fluid flowing through the heat transfer tube 10. In addition, the channel is also beneficial for the discharge of the coke pieces peeled off.

Figure 2:
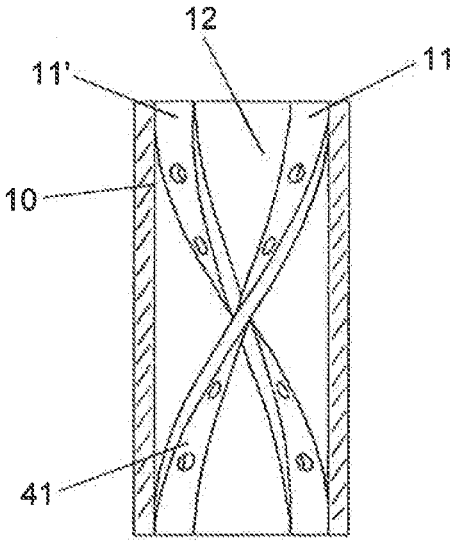
FIGS. 2 and 3 schematically show perspective views of a second embodiment of the heat transfer tube according to the present disclosure.
Figure 3:
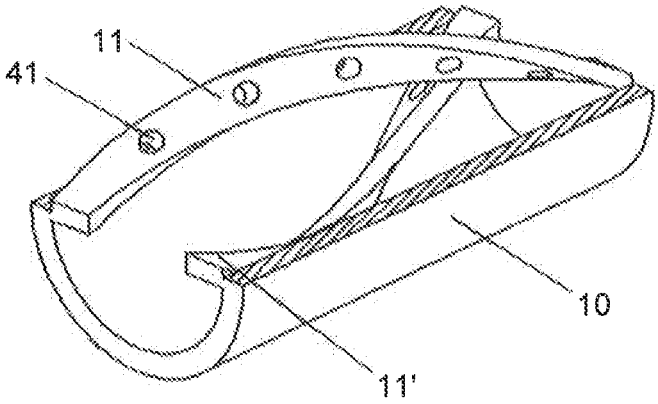

FIGS. 2 and 3 schematically show a second embodiment of the twisted baffle. In this embodiment, the twisted baffles 11 and 11' are both provided with holes 41. Taking the twisted baffle 11 as an example, fluids flowing axially or radially can both flow through the holes 41. In this way, under the guidance of the twisted baffle 11, not only can the fluid turn into rotating flow so as to reduce the thickness of the boundary layer, but also pass through the holes 41 smoothly to flow downstream, which greatly reduces the pressure loss of the fluid. Furthermore, coke pieces in the fluid can also pass through the holes 41, facilitating the operation of mechanical decoking or hydraulic decoking. FIG. 4 is a cross-section view of FIGS. 2 and 3, which explicitly demonstrates the structure of the heat transfer tube 10.

Figure 5:
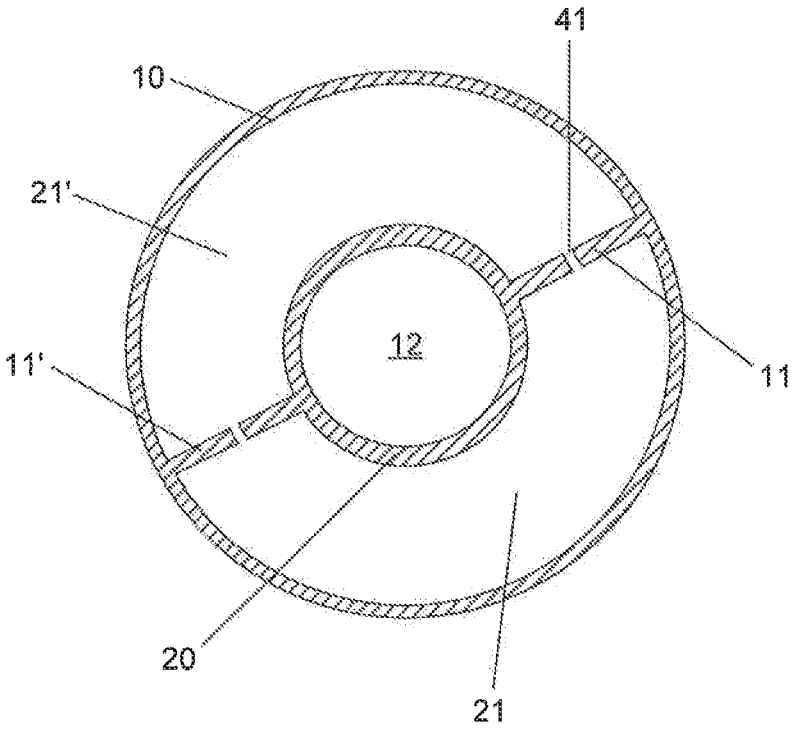
FIG. 5 schematically shows a cross-section view of a third embodiment of the heat transfer tube according to the present disclosure.

FIG. 5 schematically shows a third embodiment of the heat transfer tube 10. The structure of the third embodiment is substantially the same as that of the second embodiment. The differences therebetween lie in the following points. At the outset, in the third embodiment, along the trajectory of the vertical passage (i.e., the circle 12 in FIG. 4) a casing 20 is arranged, which is fixedly connected to radial inner ends of twisted baffles 11 and 11' so as to support the twisted baffles 11 and 11' and also improve the stability and impact resistance thereof. Besides, the casing 20, the twisted baffles 11 and 11' and an inner wall the heat transfer tube 10 together enclose spiral cavities 21 and 21'. When a fluid enters into the spiral cavities 21 and 21', it would turn from a piston flow into a rotating flow and separated by the casing 20, the rotating flow would not be influenced by the piston flow in the casing, so that the rotating flow would have a higher tangential speed, thus enhancing the heat transfer and reducing coking on the wall of the heat transfer tube. When the rotating flows flow out of the spiral cavities 21 and 21', they can enhance the turbulence of the fluid in the heat transfer tube 10 under the inertia effect thereof, thus further enhancing the heat transfer effect. In a preferred embodiment, the inner diameter ratio of the casing 20 to the heat transfer tube 10 is in a range from 0.05:1 to 0.95:1, so that coke sheets can pass through the casing 20, which facilitates the discharge of the coke sheets.

It should also be understood that although the twisted baffles 11 and 11' in the embodiment as indicated in FIG. 5 are provided with holes 41, the twisted baffles actually can also be provided with no holes in some embodiments, which will not be explained here for the sake of simplicity.

Figure 6:
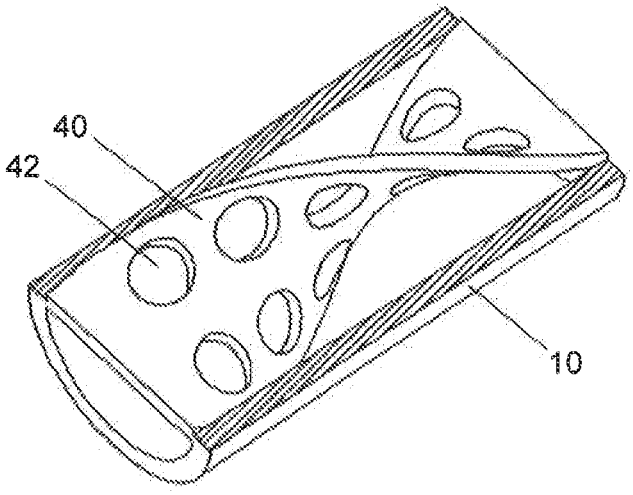
FIG. 6 schematically shows a perspective view of a fourth embodiment of he heat transfer tube according to the present disclosure.

FIG. 6 schematically indicates a fourth embodiment of the heat transfer tube 10. It should be noted that a twisted baffle 40 in FIG. 6 is different from any one of the twisted baffles in FIGS. 1 to 5 in that the twisted baffle 40 does not enclose a vertical passage as shown in FIGS. 1 to 5. The spiral twisted baffle 40 can reduce the thickness of the boundary layer and at the same time, holes 42 provided on the twisted baffle 40 decrease the resistance to the fluid flowing along the axial direction so as to reduce pressure loss thereof. In one specific embodiment, the ratio of the sum area of the plurality of holes 42 to the area of the twisted baffle 40 ranges from 0.05:1 to 0.95:1. And the ratio of an axial distance between the centerlines of two adjacent holes 42 to an axial length of the twisted baffle 40 ranges from 0.2:1 to 0.8:1.

Figure 8:
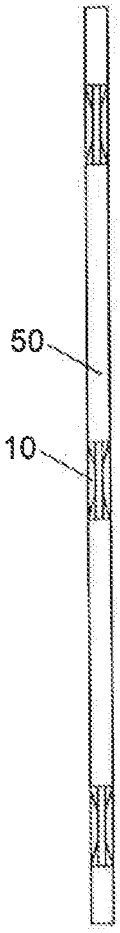
FIG. 8 schematically shows a radiant coil of a cracking furnace using the heat transfer tube according to the present disclosure.

The present disclosure further relates to a cracking furnace (not shown in the drawings) using the heat transfer tube 10 as mentioned above. A cracking furnace is well known to one skilled in the art and therefore will not be discussed here. A radiant coil 50 of the cracking furnace is provided with at least one heat transfer tube 10 as described above. FIG. 8 schematically indicates three heat transfer tubes 10. Preferably, these heat transfer tubes 10 are provide along the axial direction in the radiant coil in a manner of being spaced from each other. For example, the ratio of an axial distance of two adjacent heat transfer tubes 10 to the inner diameter of the heat transfer tube 10 is in a range from 15:1 to 75:1, preferably from 25:1 to 50:1, so that the fluid in the radiant coil would continuously turn from a piston flow to a rotating flow, thus improving the heat transfer efficiency. It should be noted that when there are a plurality of heat transfer tubes, these heat transfer tubes can be arranged in a manner as shown in any one of FIGS. 1 to 6.

In the following, specific examples will be used to explain the heat transfer efficiency and pressure drop of the radiant coil of the cracking furnace when the heat transfer tube 10 according to the present disclosure is used.

EXAMPLE 1

The radiant coil of the cracking furnace is arranged with 6 heat transfer tubes 10 as indicated in FIG. 1. The inner diameter of each of the heat transfer tubes 10 is 51 mm. The diameter ratio of the enclosed circle to the heat transfer tube is 0.6:1. The twisted baffle has a twist angle of 180° and a twist ratio of 2.5. The distance between two adjacent heat transfer tubes 10 is 50 times as large as the inner diameter of the heat transfer tube. Experiments have found that the heat transfer load of the radiant coil is 1,270.13 KW and the pressure drop is 70,180.7 Pa.

EXAMPLE 2

The radiant coil of the cracking furnace is arranged with 6 heat transfer tubes 10 as indicated in FIG. 2. The inner diameter of each of the heat transfer tubes 10 is 51 mm. The diameter ratio of the enclosed circle to the heat transfer tube is 0.6:1. The twisted baffle has a twist angle of 180° and a twist ratio of 2.5. The distance between two adjacent heat transfer tubes 10 is 50 times as large as the inner diameter of the heat transfer tube. Experiments have found that the heat transfer load of the radiant coil is 1,267.59 KW and the pressure drop is 70,110.5 Pa.

COMPARATIVE EXAMPLE 1

Figure 7:
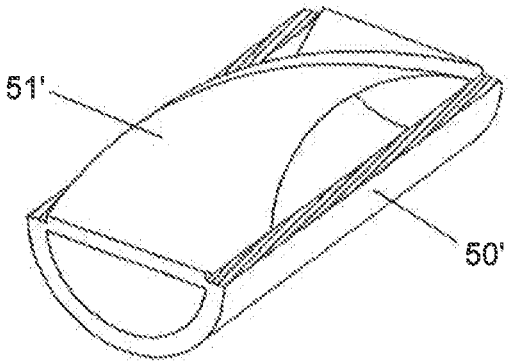
FIG. 7 schematically shows a perspective view of a heat transfer tube in the prior art.

The radiant coil of the cracking furnace is mounted with 6 prior art heat transfer tubes 50'. The heat transfer tube 50' is structured as being provided with a twisted baffle 51' in a casing of the heat transfer tube 50', the twisted baffle 51' dividing the heat transfer tube 50 into two material passages non-communicating with each other as indicated in FIG. 7. The inner diameter of the heat transfer tube 50' is 51 mm. The twisted baffle 51' has a twist angle of 180° and a twist ratio of 2.5. The distance between two adjacent heat transfer tubes 50' is 50 times as large as the inner diameter of the heat transfer tube. Experiments have found that the heat transfer load of the radiant coil is 1,264.08 KW and the pressure drop is 71,140 Pa.

In view of the above examples and comparative example, it can be derived that compared with the heat transfer efficiency of the radiant coil n the cracking furnace using the prior art heat transfer tube, the heat transfer efficiency of the radiant coil in the cracking furnace using the heat transfer tube according to the present disclosure is significantly improved. The heat transfer load of the radiant coil is improved to as high as 1,270.13 KW and the pressure drop is also well controlled to be as low as 6,573.8 Pa. The above features are very beneficial for hydrocarbon cracking reaction.

Although this disclosure has been discussed with reference to preferable examples, it extends beyond the specifically disclosed examples to other alternative examples and/or use of the disclosure and obvious modifications and equivalents thereof. Particularly, as long as there are no structural conflicts, the technical features disclosed in each and every example of the present disclosure can be combined with one another in any way. The scope of the present disclosure herein disclosed should not be limited by the particular disclosed examples as described above, but encompasses any and all technical solutions following within the scope of the following claims.

What is claimed is:

1. A cracking furnace having a radiant coil, wherein the radiant coil comprises at least one heat transfer tube, wherein the heat transfer tube comprises a twisted baffle arranged on an inner wall of the tube, said twisted baffle extending spirally along an axial direction of the heat transfer tube, wherein the twisted baffle is provided with a plurality of holes and a ratio of a sum area of the plurality of holes to an area of the twisted baffle is in a range from 0.05:1 to 0.95:1, wherein one single region of the heat transfer tube is provided with a plurality of twisted baffles parallel to one another, which define an enclosed circle viewed from one end of the heat transfer tube, and wherein a casing is arranged along a trajectory of the circle, the casing being fixedly connected to a radial inner end of the twisted baffle.

2. The cracking furnace according to claim 1, wherein the at least one heat transfer tube includes a plurality of heat transfer tubes arranged in the radiant coil along an axial direction thereof in a manner of being spaced from each other, a ratio of a spacing distance to a diameter of at least one of the plurality of heat transfer tubes is in a range from 15:1 to 75:1.

3. The cracking furnace according to claim 1, wherein the at least one heat transfer tube includes a number of heat transfer tubes ranging from 2 to 10.

4. The cracking furnace according to claim 2, wherein said ratio of the spacing distance to the diameter is in a range from 25:1 to 50:1.

5. The cracking furnace according to claim 1, wherein the twisted baffle has a twist angle of between 90° to 1080°.

6. The cracking furnace according to claim 1, wherein a diameter ratio of the circle to the at least one heat transfer tube falls within a range from 0.05:1 to 0.95:1.

7. The cracking furnace according to claim 1, wherein a ratio of an axial length of the twisted baffle to an inner diameter of the at least one heat transfer tube is in a range from 1:1 to 10:1.

8. The cracking furnace according to claim 5, wherein said twist angle is in a range from 120° to 360°.

9. The cracking furnace according to claim 6, wherein said diameter ratio is in a range from 0.6:1 to 0.8:1.

10. The cracking furnace according to claim 7, wherein said ratio of the axial length to the inner diameter is in a range from 2:1 to 4.1.

11. The cracking furnace according to claim 1, wherein the ratio is in a range from 0.6:1 to 0.8:1.

12. The cracking furnace according to claim 1, wherein a ratio of an axial distance between centerlines of two adjacent holes to an axial length of the twisted baffle ranges from 0.2:1 to 0.8:1.

* * * * *